US005997310A

United States Patent [19]

Chiu et al.

[11] Patent Number: 5,997,310

[45] Date of Patent: Dec. 7, 1999

[54] SWIVEL ELECTRIC PLUG

[76] Inventors: Pen-Li Chiu, 5F., No. 5, Lane 94, Chung Hsin Street, Hsinchuan City, Taipei Hsien; Wen-Chin Chien, No. 19, Alley 12, Lane 210, Ding Kan Street, Sanchung City, Taipei Hsien, both of Taiwan

[21] Appl. No.: 09/176,220

[22] Filed: Oct. 21, 1998

[51] Int. Cl.[6] ..... H01R 39/00

[52] U.S. Cl. ..... 439/21; 439/11

[58] Field of Search ..... 439/13, 20, 21, 439/22, 27, 11, 17, 18, 19

[56] References Cited

U.S. PATENT DOCUMENTS 4,624,513 11/1986 Haraden ..... 439/21

5,775,921 7/1998 Chou ..... 439/21

*Primary Examiner*—Michael L. Gellner

*Assistant Examiner*—Antoine Ngangjui

*Attorney, Agent, or Firm*—Dougherty & Troxell

[57] ABSTRACT

A swivel electric plug includes a base block having three annular terminal grooves concentrically provided in a recessed surface and a coupling groove around the recessed surface. Three annular metal plates are fastened in to the annular terminal grooves and connected to a respective wire in an electric wire being fastened to the base block. A circular cover plate is rotatably mounted on the recessed surface of the base block, the circular cover plate having a peripheral bottom coupling flange coupled to the coupling groove on the base block and holding two metal blades and a grounding prong. The metal blades and the ground prong each have an inner contact end respectively disposed in contact with the annular metal plates in the annular terminal grooves of said base block.

8 Claims, 5 Drawing Sheets

SWIVEL ELECTRIC PLUG

BACKGROUND OF THE INVENTION

The present invention relates to electric plugs, and more specifically to a swivel electric plug which, when installed in an electric socket, can be rotated to the desired angle.

Regular electric plugs include two types, one having two metal blades, the other having two metal blades and one grounding prong. Because the angular positions of the metal blades (and the grounding prong) of an electric plug can not be adjusted relative to the electric wire of the electric plug, the installation direction is limited. FIG. 6 shows a swivel electric plug according to the prior art which can be rotated to the desired angle after its installation in an electric socket. This swivel electric plug is comprised of a bottom cover shell, a top cover shell, a rotary cap, two metal blades, a grounding prong, and two annular metal plates of different sizes. Because this swivel electric plug consists of a number of parts, its installation is complicated, and its manufacturing cost is high. Another drawback of this structure of swivel electric plug is that the parts tend to be damaged or forced out of place when vibrated, causing an electric contact error. Furthermore, the mounting arrangement of this structure of swivel electric plug can not prohibit water from passing to the inside of the swivel electric plug. Because the top cover shell is fastened to the bottom cover shell by screws, water can easily pass through gaps in between the cover shells to wet the electric circuit, causing a short circuit.

SUMMARY OF THE INVENTION

It is one object of the present invention to provide a swivel electric plug which has a simple structure. It is another object of the present invention to provide a swivel electric plug which can easily be assembled. It is still another object of the present invention to provide a swivel electric plug which effectively seals out water. To achieve these and other objects of the present invention, there is provided a swivel electric plug comprised of a base block, which comprises three annular terminal grooves concertrically provided at a recessed surface thereof, a coupling groove around the recessed surface, a top center male coupling member, and three annular metal plates respectively fastened to the annular terminal grooves and connected to a respective conductor in an electric wire being fastened to the base block. A circular cover plate is rotatably mounted on the recessed surface of the base block, the circular cover plate comprising a peripheral bottom coupling flange coupled to the coupling groove at the base block and a bottom center female coupling member coupled to the top center male coupling member of the base block and holding two metal blades and grounding prong. The metal blades and the ground prong each having an inner contact end respectively disposed in contact with the annular metal plates in the annular terminal grooves of said base block.

DETAILED DESCRIPTION OF THE PREFERRED EMBODIMENT

Figure 1:
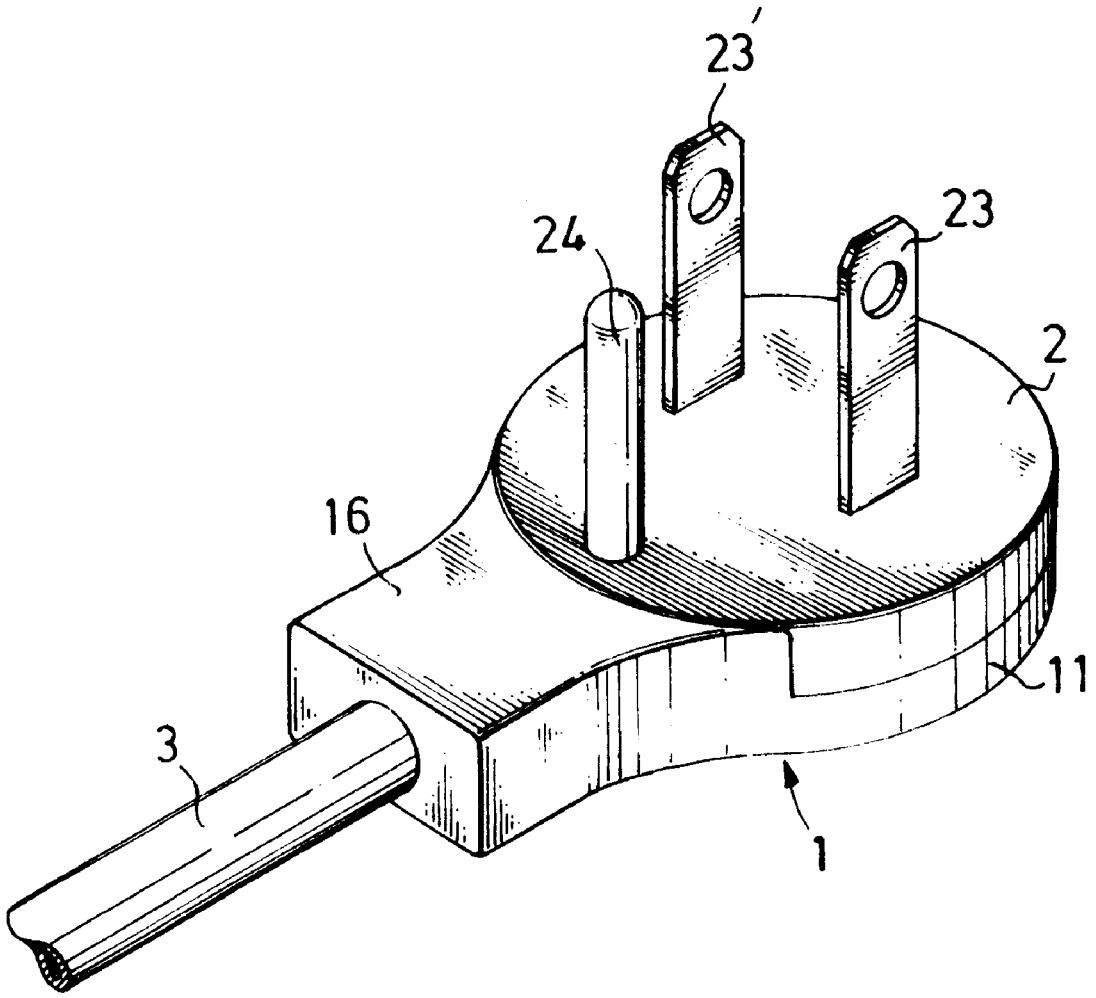
FIG. 1 is a perspective view of a swivel electric plug according to the present invention.
Figure 2:
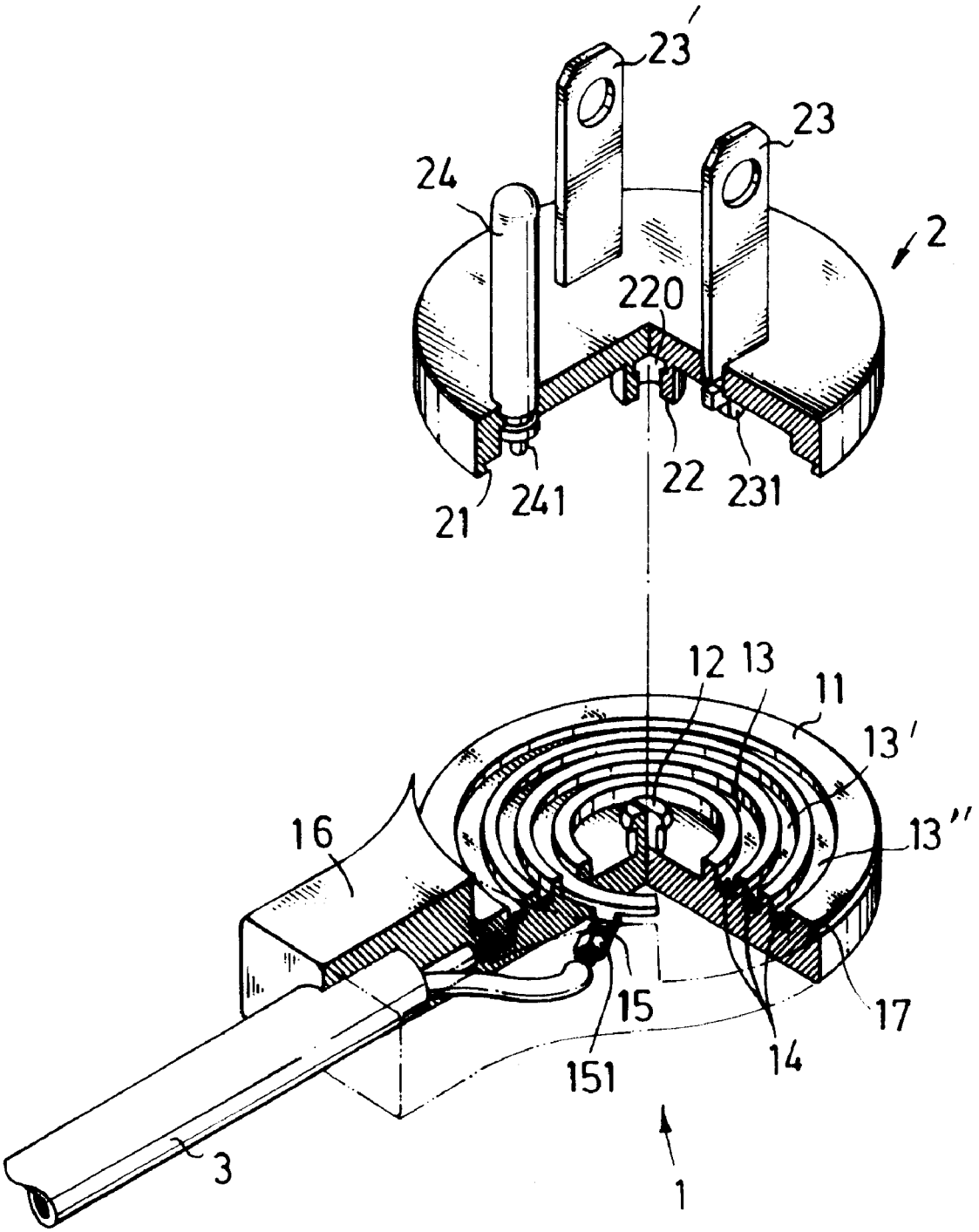
FIG. 2 is an exploded, view of the swivel electric plug according to the present invention.
Figure 3:
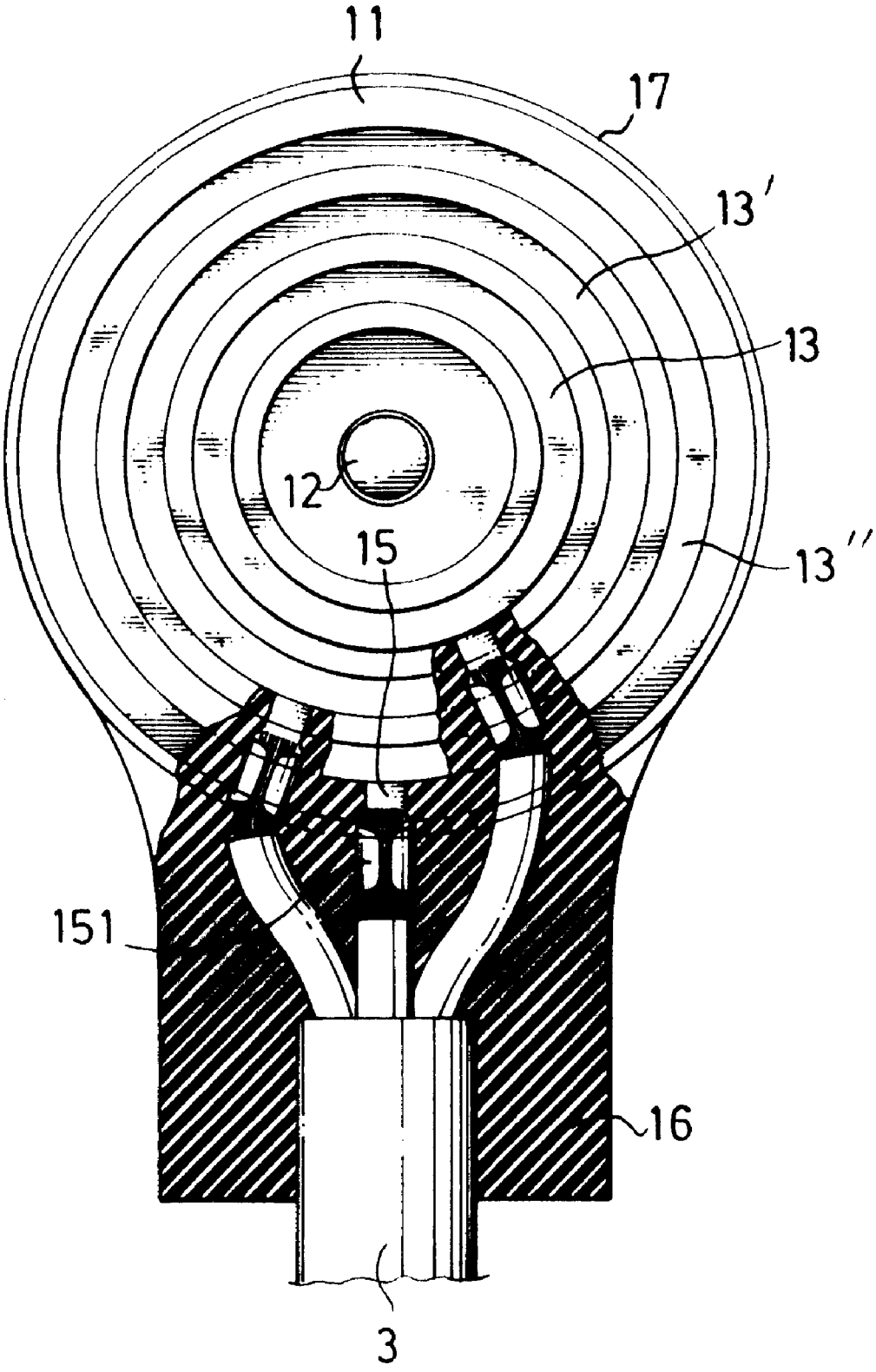
FIG. 3 is a plain view partially broken away of the base block according to the present invention.

Referring to Figures from 1 through 5, a swivel electric plug is shown comprised of a base block 1, and a circular cover plug 2.

The base block 1 comprises a hollow neck 16 at one end, a recessed surface 11 in front of the neck 16, a coupling groove 17 provided around the recessed surface 11, a flanged upright coupling rod 12 raised from the center of the recessed surface 11, and a plurality of (for example, three) annular terminal grooves 13, 13', 13" concentrically provided in the recessed surface 11 around the flanged upright coupling rod 12. A plurality of (for example, three) annular metal plates 14 are respectively mounted in the annular terminal grooves 13, 13', 13". The annular metal plates 14 each have a projecting strip 15. The flat projecting strip 15 of each annular metal plate 14 has two wings 151. An electric wire 3 is inserted through the hollow neck 16 of the base block 1, permitting the grounding wire, hot wire and neutral wire thereof to be respectively fastened to the projecting strips 15 of the annular metal plates 14 and firmly secured thereto by the respective wings 151 (the wings 151 are respectively bent inwards to secure the wires of the electric wire 3 to the respective projecting strips 15).

The circular cover plate 2 fits on the circular recessed surface 11, c omprising a bottom coupling flange 21 extending from the bottom side wall thereof around the periphery for coupling to the coupling groove 17 of the base block 1, and a downward coupling rod 22 raised from the center of the bottom side wall for coupling to the upright coupling rod 12 of the base block 1. The downward coupling rod 22 defines a coupling hole 220 for receiving the flanged upright coupling rod 12 of the base block. The coupling hole 220 has retaining means to hold the flange of the upright coupling rod 12 when the upright coupling rod 12 is inserted into the coupling hole 220. Further, two metal blades 23, 23' and a grounding prong 24 are fixedly fastened to the circular cover plate 2 and perpendicularly protrude from over the front side wall of the circular cover plate 2. The metal blades 23, 23' and the grounding prong 24 have a respective inner contact end 231, 231' 241 for contacting the annular metal plates 14 in the annular terminal grooves 13, 13', 13" respectively. The inner contact end 231' of one metal blade 23' is bent outwards through 90° . Therefore, the inner contact ends 231, 231' of the metal blades 23, 23' can be respectively inserted into the inner annular groove 13 and the intermediate annular groove 13' to contact the respective annular metal plates 14 when the metal blades 23, 23' are fastened to the circular cover plate 2 and equally spaced from the center of the circular cover plate 2.

Figure 5:
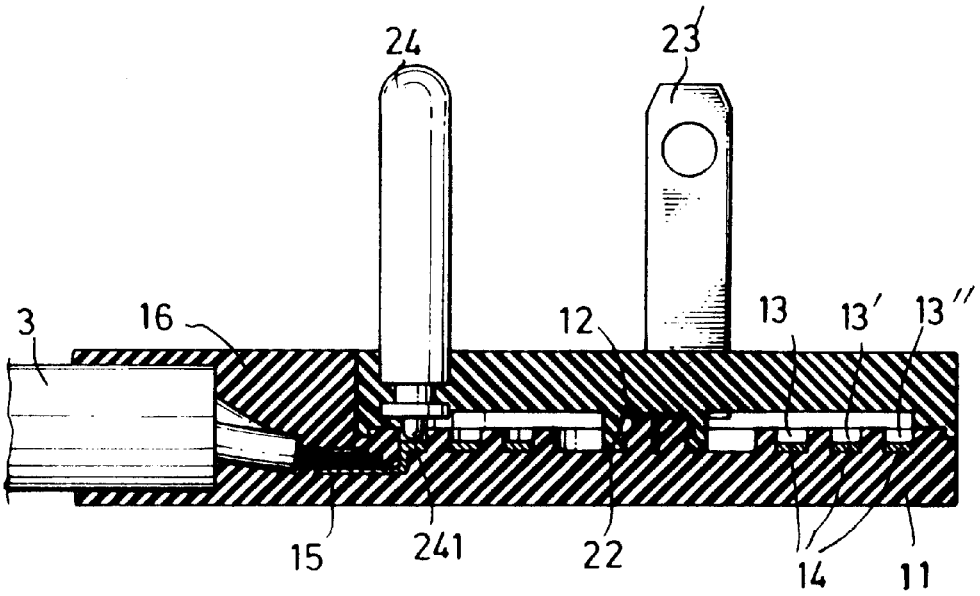
FIG. 5 is another sectional side view of the present invention, showing the angular position of the circular cover plate adjusted.
Figure 4:
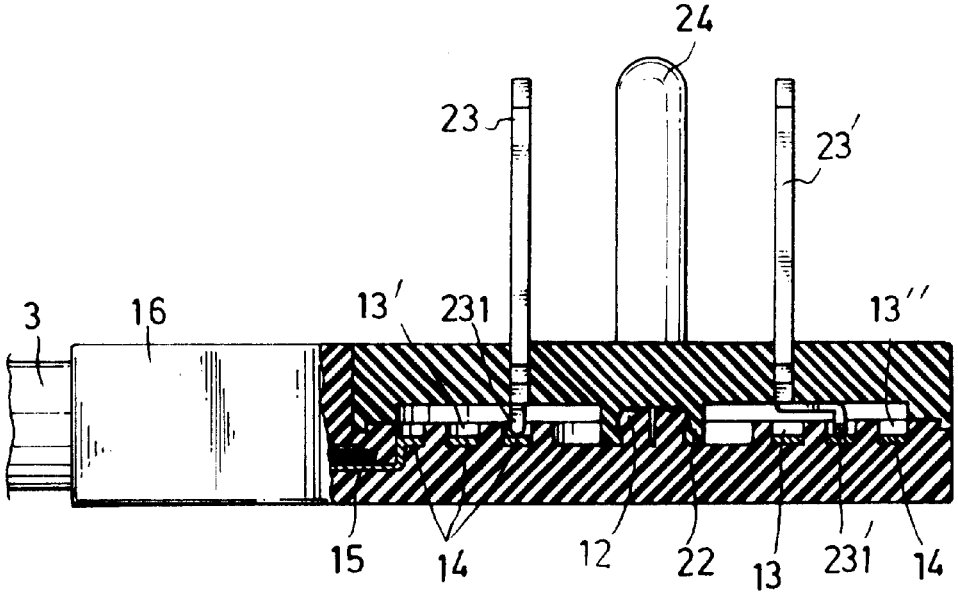
FIG. 4 is a sectional side view of the swivel electric plug according to the present invention.
Figure 6:
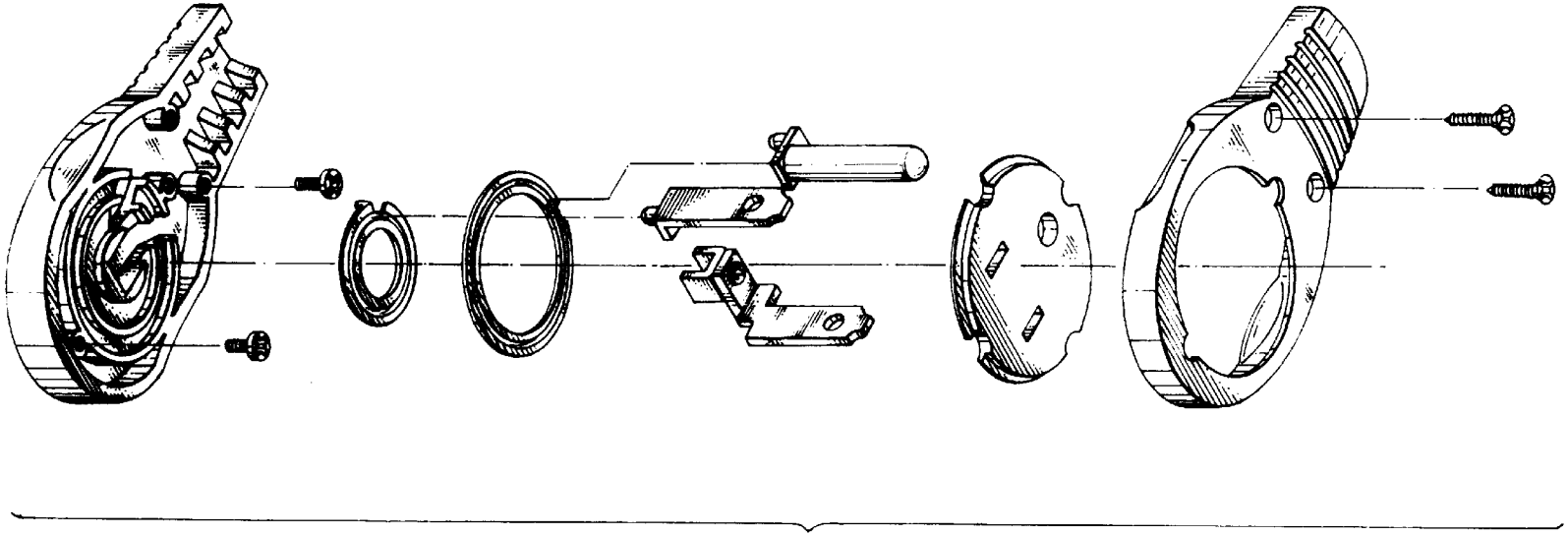
Fig. 6 PRIOR ART
FIG. 6 is an exploded view of a swivel electric plug according to the prior art.

Referring to FIGS. 4 and 5, when the circular cover plate 2 is mounted on the circular recessed surface 11 of the base block 1, the flanged upright coupling rod 12 of the base block 1 is forced into the coupling hole 220 of the downward coupling rod 22 of the circular cover plate 2 and the coupling flange 21 of the circular cover plate 2 is coupled to the coupling groove 17 at the base block 1. When assembled, the inner contact ends 231, 231', 241 of the metal blades 23, 23' and the grounding prong 24 are retained in contact with the annular metal plates 14 in the annular terminal grooves 13, 13', 13" respectively, and the circular cover plate 2 may be rotated on the flanged upright coupling rod 12 of the base block 1. When the circular cover plate 2 is rotated on the flanged upright coupling rod 12 of the base block 1, the inner contact ends 231, 231', 241 of the metal blades 23, 23' and the grounding prong 24 are constantly maintained in contact with the annular metal plates 14 in the annular terminal grooves 13, 13', 13".

While only one embodiment of the present invention has been shown and described, it will be understood that various modifications and changes could be made thereunto without departing from the spirit and scope of the invention disclosed. For example, the annular metal plates 14 can be made having a respective top sliding groove for guiding the rotary motion of the metal blades 23, 23' and the grounding prong 24, and the inner contact ends 231, 231', 241 of the metal blades 23, 23' and the grounding prong 24 are made having a respective bottom projection respectively inserted into the top sliding grooves at the annular metal plates 14. Alternaitvely, the annular metal plates 14 can be made having a respective top rib for guiding the rotary motion of the metal blades 23, 23' and the grounding prong 24, and the inner contact ends 231, 231', 241 of the metal blades 23, 23' and the grounding prong 24 are made having a respective bottom notch respectively coupled to the top ribs at the annular metal plates 14.

We claim:

1. A swivel electric plug comprising:

a) a base block having a hollow neck, a recessed surface adjacent to said hollow neck, a plurality of concentric annular terminal grooves extending into the recessed surface, a coupling groove extending into the recessed surface at a periphery of the recessed surface;

b) an annular metal plate mounted in each of the plurality of terminal grooves;

c) a multi-conductor electric wire extending through the hollow neck of the base block, each conductor connected to one annular metal plate;

d) a circular cover plate rotatably attached to the recessed surface of the base block, the cover plate having a coupling flange extending therefrom and coupled in the coupling groove of the base block; and e) a plurality of metal contact elements mounted on the cover plate and extending therefrom, each contact element having an inner contact end in contact with one of the plurality of annular metal plates in the base block.

2. The swivel electric plug of claim 1 wherein said plurality of metal contact elements includes two metal blades equally spaced from a center of said circular cover plate, the inner contact end of one metal blade being a straight end disposed in contact with the annular metal plate in one annular terminal groove, and the inner contact end of the other metal blade being bent outwards through 90° and in contact with the annular metal plate in a second annular terminal groove.

3. The swivel electric plug of claim 1 wherein the inner contact ends of said plurality of metal contact elements each have a bottom notch, and the annular metal plates which are mounted in the annular terminal grooves of said base block each have a top ridge engaging the bottom notches of the inner contact ends to guide rotary motion of said plurality of metal contact elements with said circular cover plate.

4. The swivel electric plug of claim 1 wherein the inner contact ends of said plurality of metal contact elements each have a bottom projection, and said annular metal plates each have a top groove engaging the bottom notches of the inner contact ends to guide rotary motion of said metal contact elements with said circular cover plate.

5. The swivel electric plug of claim 1 wherein said plurality of metal contact elements include two metal blades and a grounding prong.

6. The swivel electric plug of claim 1 wherein said base block further comprises an upright male coupling member extending from the recessed surface, and said circular cover plate further comprises a downward female coupling member extending from a center of a bottom side wall thereof and coupled to the upright male coupling member to rotatably secure said circular cover plate to said recessed surface of the base block.

7. The swivel electric plug of claim 6 wherein said downward female coupling member of said circular cover plate comprises a coupling rod having an axially extending bottom hole, and said upright male coupling member of said base block is a coupling rod inserted into the axially extending bottom hole of the coupling rod of said downward female coupling member.

8. The swivel electric plug of claim 7 wherein the coupling rod of said upright male coupling member has a coupling rod flange and the axially extending bottom hole of the coupling rod has retaining means to ensure the coupling rod flange in place.

* * * * *